US005503279A

United States Patent [19]

Wentworth

[11] Patent Number: 5,503,279

[45] Date of Patent: Apr. 2, 1996

[54] ADJUSTABLE DISPLAY RACK

[76] Inventor: Richard W. Wentworth, 4924 S. Logan St., Lansing, Mich. 48910

[21] Appl. No.: 226,956

[22] Filed: Apr. 13, 1994

[51] Int. Cl.[6] ..... A47F 5/00

[52] U.S. Cl. ..... 211/175; 211/150; 211/181

[58] Field of Search ..... 211/175, 181, 211/186, 149, 127, 153, 150

[56] References Cited

U.S. PATENT DOCUMENTS 5,314,080 5/1994 Wentworth ..... 211/181

*Primary Examiner*—Robert W. Gibson, Jr.
*Attorney, Agent, or Firm*—Lynn E. Cargill

[57] ABSTRACT

One embodiment is a height-adjustable, angle-adjustable display rack which includes a base frame having a front end and a rear end; an angle-adjustable uniplanar tilt top having a top end, a bottom end, and two sides connecting the top end and the bottom end; and a tilt bar attachable to the tilt top and attachable to the base frame at various distances from the front end of the base frame.

Another embodiment is a height-adjustable, angle-adjustable display rack which includes a base frame having a front end and a rear end; a tilt top having a top end, a bottom end, and two sides connecting the top end and the bottom end, the tilt top being attachable to the base frame at various distances from the front end of the base frame; and a tilt bar attachable to the tilt top and the base frame in such a way that the tilt top may be supported at various angles. The tilt top may be expandable to expand its height from the top end to the bottom end.

15 Claims, 2 Drawing Sheets

ADJUSTABLE DISPLAY RACK

BACKGROUND OF THE INVENTION

1. Field of the Invention

The present invention relates generally to display racks and, more particularly, to height-adjustable, angle-adjustable display racks.

2. Description of the Related Art

In the retail industry, particularly in the grocery industry, it is desirable to aesthetically display products and to display the products in a manner in which the products appear to be abundant with only a minimum of product in stock. It is also desirable to present products, especially produce, having a uniform side profile along a section of a refrigerated display case. For instance, it is pleasant to the customer to see various produce displayed having a uniform look despite the produce's varying heights. For example, romaine lettuce is generally about 12" high and Boston lettuce is generally about 2" high. It would be advantageous for a grocer to be able to display these lettuces side-by-side yet present a uniform upper surface.

Current display racks offer some adjustability, but there remains a need for a display rack which offers full versatility in terms of being height-adjustable, angle-adjustable, and length-adjustable, is easy to use, of simple design and sturdy construction, fits standard display cases, and can display loose product or products in containers.

SUMMARY OF THE INVENTION

It is, therefore, one object of the present invention to provide a display rack which displays products so that they appear to be abundant with only a minimum of product in stock.

It is another object of the present invention to provide a display rack which displays products with a uniform side profile.

It is yet another object of the present invention to provide a display rack which is height-adjustable, angle-adjustable, and length-adjustable, is easy to use, is of simple design and sturdy construction, fits standard display cases, and can display loose product or products in containers.

To achieve the foregoing objects, one embodiment of the present invention is a height-adjustable, angle-adjustable display rack which includes a base frame having a front end and a rear end; an angle-adjustable uniplanar tilt top having a top end, a bottom end, and two sides connecting the top end and the bottom end; and a tilt bar attachable to the tilt top and attachable to the base frame at various distances from the front end of the base frame.

Another embodiment of the present invention is a height-adjustable, angle-adjustable display rack which includes a base frame having a front end and a rear end; a tilt top having a top end, a bottom end, and two sides connecting the top end and the bottom end, the tilt top being attachable to the base frame at various distances from the front end of the base frame; and a tilt bar attachable to the tilt top and the base frame in such a way that the tilt top may be supported at various angles. The tilt top may be expandable to expand its height from the top end to the bottom end.

One advantage of the present invention is that a display rack is provided for displaying products so that they appear to be abundant with only a minimum of product in stock. Another advantage of the present invention is that a display rack is provided which displays products with a uniform side profile even though the products themselves may have varying heights. Yet another advantage of the present invention is that a display rack is provided which is height-adjustable, angle-adjustable, and length-adjustable, is easy to use, is of simple design and sturdy construction, fits standard display cases, and can display loose product or products in containers.

Other objects, features, and advantages of the present invention will be readily appreciated as the same becomes better understood after reading the subsequent description taken in conjunction with the appendant drawings.

DESCRIPTION OF THE PREFERRED EMBODIMENT(S)

Figure 1:
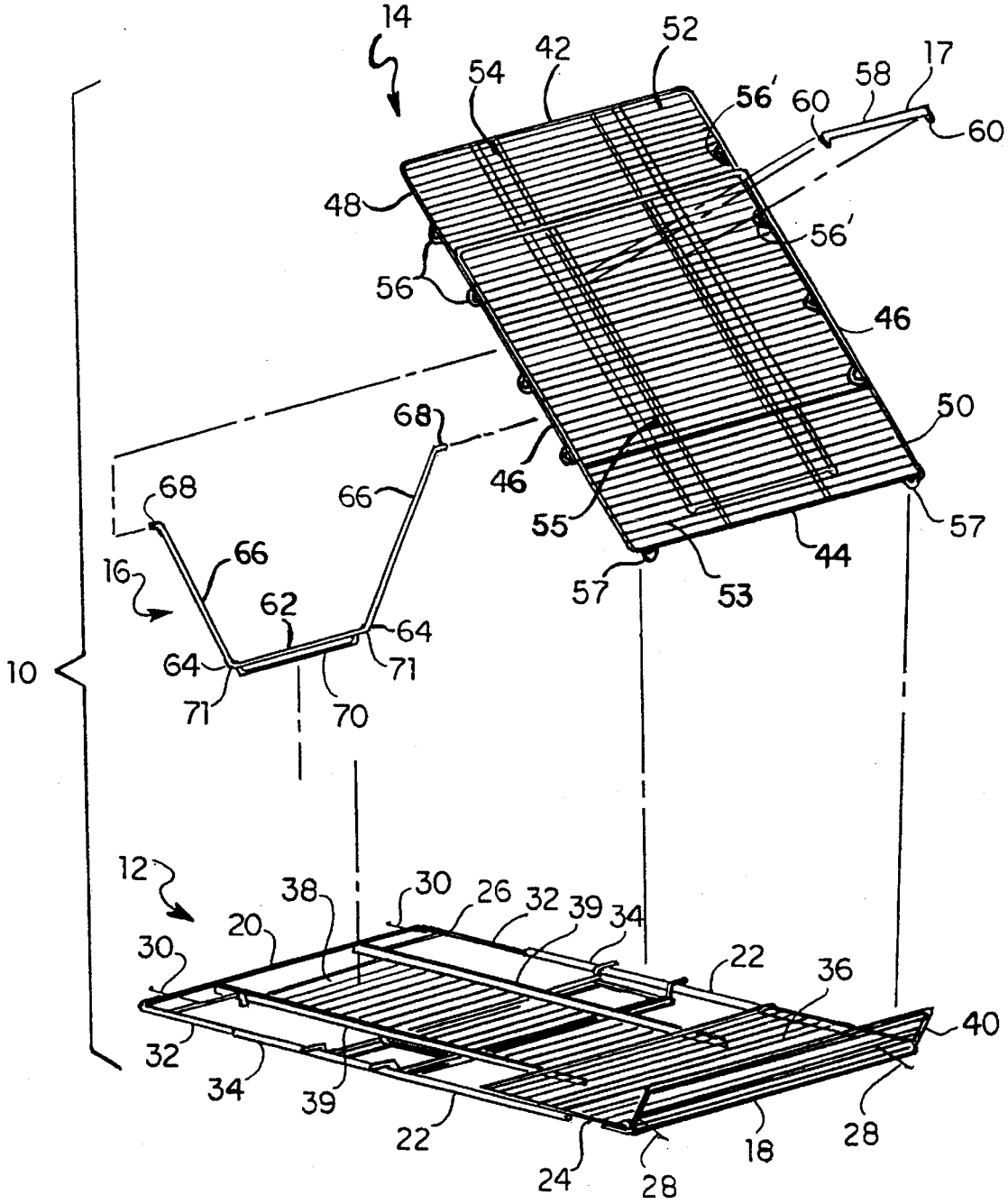
FIG. 1 is an exploded perspective view of a display rack according to the present invention.

Referring to FIG. 1, a display rack 10 for displaying products in a display wall case is shown having a base frame 12, a tilt top 14, a tilt bar 16, and a locking bar 17. The display rack 10 is designed to fit inside a display wall case (not shown) and may be formed of epoxy-coated metal. The base frame 12 has a front end 18, a rear end 20, two sides 22 connecting the front end 18 to the rear end 20, a front portion 24 and a rear portion 26. The base frame 12 has two hooks 28 projecting from the front end 18 and two hooks 30 projecting from the rear end 20. The hooks 28 and 30 lock into corresponding holes in the front and back of a display wall case to lock the base frame 12 in place. It is preferred that the base frame 12 form a level surface inside the display wall case.

The rear portion 26 of the base frame 12 has slideable rods 32, and the front portion 24 has tubes 34 into which slideable rods 32 can telescope. The telescoping feature of the base frame 12 renders the base frame 12 length-adjustable so that it may fit into display wall cases of various lengths.

The front portion 24 and the rear portion 26 of the base frame 12 have rungs 36 and 38, respectively, which are parallel with the front and rear ends 18 and 20 of the base frame 12. The rear portion 26 of the base frame 12 has cross wires 39 which are perpendicular to the front and rear ends 18 and 20 of the base frame 12.

The base frame 12 also has a foldable product fence 40 at the front end 18 which prevents product from rolling off the base frame 12 and folds away when not in use.

The tilt top 14 has a top end 42, a bottom end 44, two sides 46 connecting the top end 42 to the bottom end 44, a top portion 48, and a bottom portion 50. The top and bottom portions 48 and 50 are slideable with each other so that the tilt top 14 is expandable in height.

The top portion 48 has rungs 52 which are parallel with the top and bottom ends 42 and 44 and cross wires 54 which are perpendicular to the top and bottom ends 42 and 44. The bottom portion 50 has rungs 53 which are parallel with the top and bottom ends 42 and 44 and cross wires 55 which are perpendicular to the top and bottom ends 42 and 44. The rungs 52 on the top portion 48 are equidistantly-spaced and spaced the same distance apart as the rungs 53 on the bottom portion 50. The cross wires 54 on the top portion 48 are spaced apart and positioned directly below the cross wires 54 on the bottom portion 50.

The tilt top 14 is shown as being uniplanar, but, alternatively, the tilt top 14 may have a pivoting point so that the tilt top is bendable into a step or the tilt top may be formed having one or more permanent steps.

The tilt top 14 also has loops 56 and 56' extending downwardly from the sides 46, loops 56 being on one side of the tilt top 14 and loops 56' being on the other side. For each loop 56 there is a corresponding loop 56'. Loop 56 and its corresponding loop 56' are equidistant from the bottom end 44 of the tilt top 14 and will be referred to as a "pair of loops", whose function will be discussed hereinbelow. The bottom end 44 of the tilt top 14 is equipped with circular hooks 57 which are designed to fit between any two of the rungs 36 of the front portion 24 of the base frame 12. Due to the numerous rungs 36, the bottom end 44 of the tilt top 14 may be attached to the base frame 12 at various distances from the front end 18 of the base frame 12.

The locking bar 17 consists of an elongated bar 58 and a short extension 60 extending from each end of the elongated bar 58. The locking bar 17 is sized so that the short extensions 60 fit snugly around the outsides of two cross wires 55 on the bottom portion 50 and two cross wires 54 directly below on the top portion 48 of the tilt top 14. The short extensions 60 fit around the underside of the two cross wires 54 to a small degree to hold the locking bar in place. The short extensions 60 fit, e.g., spring-fit, on the outside of two of the cross wires 54 and between two of the adjacent rungs 52 of the top portion 50 and two of the adjacent rungs 53 of the bottom portion 48 to secure the tilt top 14 in the desired height expansion.

The tilt bar 16 is present to provide support for the tilt top 14 and to render the tilt top 14 angle-adjustable. The tilt bar 16 has a flat bottom 62 having two ends 64 and an arm 66 extending upwardly and outwardly from each end 64. Each arm 66 terminates with a tip 68, each of which extends outwardly and parallel with the flat bottom 62.

The flat bottom 62 has a U-shaped wire 70 which extends from the bottom of the flat bottom 62. The U-shaped wire 70 is shorter in length than the flat bottom 62 leaving support surfaces 71 at both ends 64 of the flat bottom 62. The U-shaped wire 70 fits between any two adjacent rungs 38 of the rear portion 26 of the base frame 12, so that the tilt bar 16 may be attached to the base frame 12 at various distances from the front end 18 of the base frame 12. When the tilt bar 16 is in place on the base frame 12, the support surfaces 71 of the tilt bar 16 rest on the cross wires 39 of the base frame 12, which are spaced apart appropriately so that the support surfaces 71 may rest thereon.

The tips 68 of the tilt bar 16 and the loops 56 and 56' on the tilt top 14 are sized so that the tips 68 are insertable into the loops 56 and 56'. To insert the tips 68 into a pair of loops, the arms 66 of the tilt bar 16 are squeezed together slightly and one of the tips 68 is then inserted into a loop 56 of a pair of loops and the other of the tips 68 is inserted into the corresponding loop 56' of the pair of loops. The arms 66 of the tilt bar 16 are spring-biased outwardly so that the tips 68 tend to stay inserted into the pair of loops. Since there are several pairs of loops, the loops of the pair being equidistant from the bottom end 44 of the tilt top 14, the tilt bar 16 may be attached to the tilt top 14 at various distances from the bottom end 44 of the tilt top 14. The tilt bar 16, thus, supports the tilt top 14 at various angles depending where the tilt bar 16 is attached to the base frame 12 and where it is attached to the tilt top 14.

The display rack 10 is typically assembled by first locking the base frame 12 to a display wall case as discussed hereinabove. Then the bottom end 44 of the tilt top 14 is attached at the desired location near the front end 18 of the base frame 12. The tilt top 14 is then adjusted to the desired height and locked into place using the locking bar 17. The tilt bar 16 is then attached to the tilt top 14 by inserting the tips 68 of the tilt bar 16 into the loops 56 and 56' on the tilt top 14. The tilt bar 16 is then attached to the base frame 12 at the desired location by placing the U-shaped wire 70 between two adjacent rungs 38 on the base frame 12.

Additional versatility of the display rack 10 can be achieved by using various sizes of the different components, i.e., the base frame, the tilt top, and the tilt bar. For example, different sizes of the tilt bar may be used with the same base frame and tilt top to achieve different display angles. By displaying product at a high angle, the display case appears to be full with a minimum of product.

To use the display racks of the present invention and achieve a uniform side profile of product, the display racks are placed in position depending on the product being displayed. For example, one display rack may display romaine lettuce on an angle. A display rack adjacent the romaine lettuce display may display Boston lettuce, which is shorter than the romaine lettuce. The display rack displaying the Boston lettuce has the tilt top connected to the base frame at a location nearer the front end of the base frame than does the display rack displaying the romaine lettuce. The two display racks are set up having the same angle, and the result is that the upper surface of the two lettuces is flat thereby having a uniform side profile.

Figure 2:
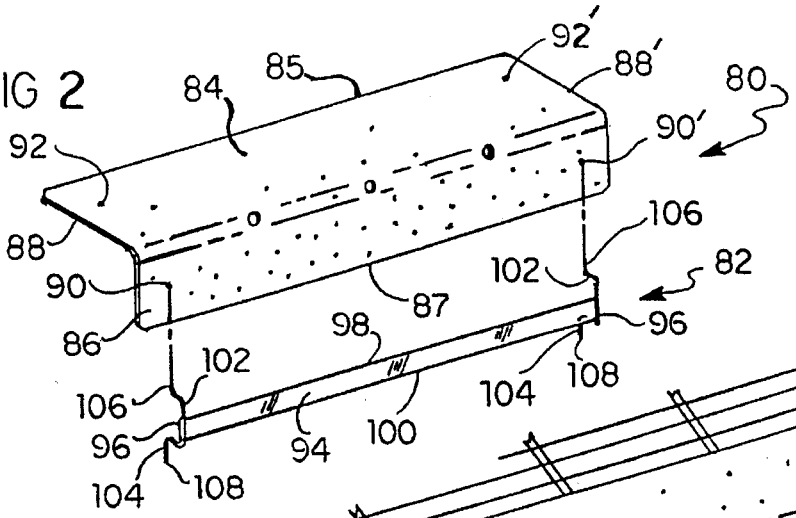
FIG. 2 is an exploded perspective view of a product step and locking clip which may be used with the display rack of the present invention

FIG. 2 shows an optional product step 80 and a locking clip 82 for locking the product step 80 onto the tilt top 14 of the display rack 10. The product step 80 may be formed of plastic, such as ABS plastic, is elongated and has an L-shaped cross section having a long leg 84 with a flat end 85 and a short foot 86 with a flat end 87. The product step 80 has two sides 88 and 88', a hole 90 in the short foot 86 near the side 88, a hole 90' in the short foot 86 near the side 88', a hole 92 in the long leg 84 near the side 88, and a hole 92' in the long leg 84 near the side 88'. The holes 90 and 90' are equidistant from the end 87 of the product step 80, and the holes 92 and 92' are equidistant from the end 85 of the product step 80. When the product step 80 is placed on the tilt top 14 as shown in FIG. 3, the long leg 84 of the product step 80 forms a step on the tilt top 14 which may be used to support containers, such as baskets of berries or bottles of apple cider.

Figure 3:
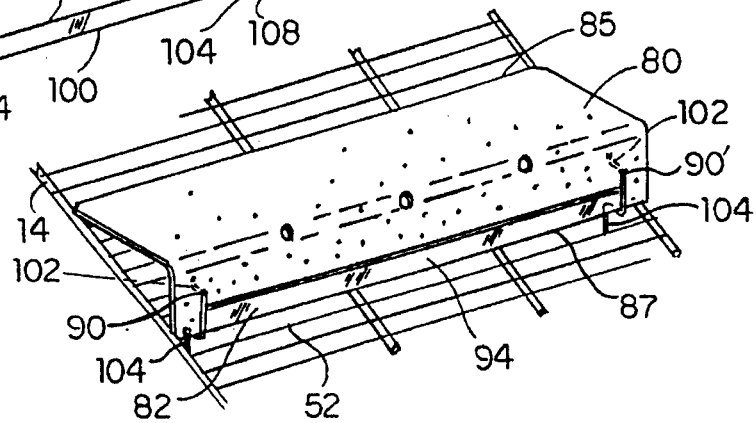
FIG. 3 is a perspective view of the product step and locking clip of FIG. 2 shown attached to a portion of a display rack of the present invention.

The product step 80 is attached to the tilt top 14 using the locking clip 82 as shown in FIG. 3. The locking clip 82 has an elongated strip 94 having two ends 96, a top edge 98 and a bottom edge 100. The locking clip 82 has two L-shaped pins 102 projecting from the top edge 98 of the elongated strip 94. One pin 102 is near one end 96 of the locking clip 82, and the other pin 102 is near the other end 96 of the locking clip 82. The locking clip 82 also has two L-shaped pins 104 projecting from the bottom edge 100 of the elongated strip 94. One pin 104 is near one end 96 of the locking clip 82, and the other pin 104 is near the other end 96 of the locking clip 82. Each pin 102 has a terminating end 106 and is connected to the elongated strip 94 so that the terminating end 106 is pointed away from the elongated strip 94. Each pin 104 has a terminating end 108 and is connected to the elongated strip 94 so that the terminating end 108 is pointed away from the elongated strip 94. The pins 104 form a larger "L" than the pins 102.

To attach the product step 80 to the tilt top 14, the pins 102 of the locking clip 82 are inserted into the holes 90 and 90' of the product step 80 until the elongated strip 94 of the locking clip is flush with the short foot 86 of the product step 80, as shown in FIG. 3. The pins 104 are then inserted between any two adjacent rungs 52 and/or 53 of the tilt top 14. If the product step 80 is placed on the tilt top 14 where the rungs 52 of the top portion 48 are directly under the rungs 53 of the bottom portion 50, then the pins 104 are inserted between two adjacent rungs 52 on the top portion 48 and two adjacent rungs 53 on the bottom portion 50. The ends 85 and 87 of the product step 80 then rest against the tilt top 14, forming a step for supporting product containers and the like.

Alternatively, the product step 80 may be reversed on the tilt top 14 such that the step for supporting containers and the like is the short foot 86. In this position, the pins 102 would be inserted into holes 92 and 92' of the product step 80 and the pins 104 would be inserted between any two adjacent rungs 52 and/or 53 of the tilt top 14 similar to the manner described for attaching the product step 80 to the tilt top 14 as discussed with reference to FIG. 3.

Figure 4:
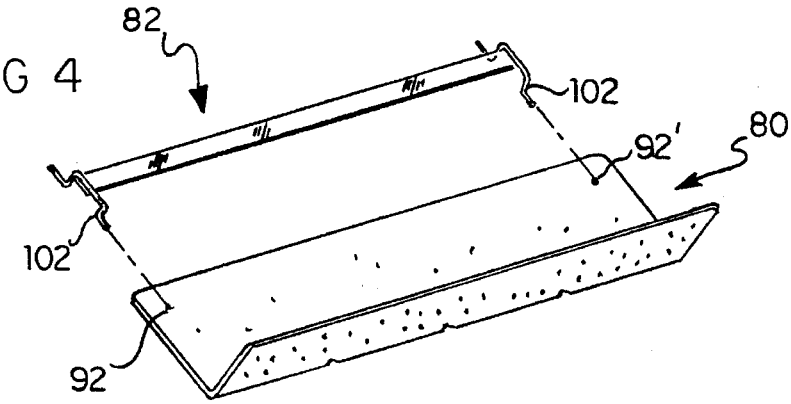
FIG. 4 is an exploded perspective view of an inverted product step and locking clip which may be used with the display rack of the present invention.
Figure 5:
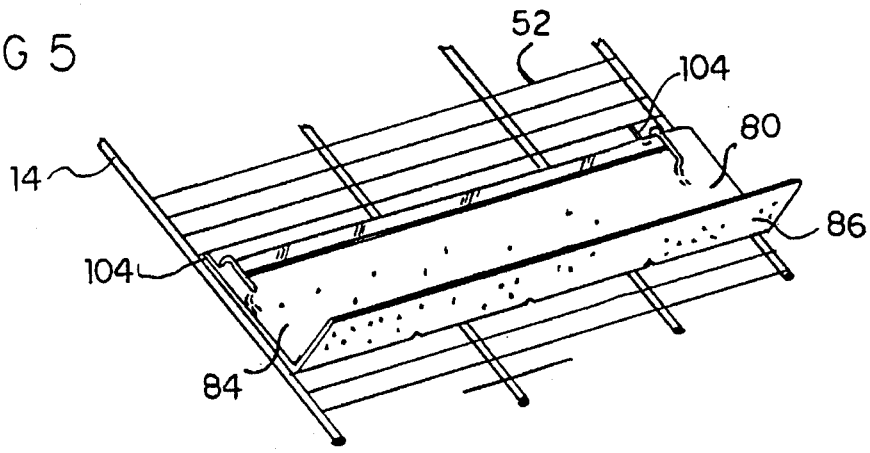
FIG. 5 is a perspective view of the inverted product step and locking clip of FIG. 4 shown attached to a portion of a display rack of the present invention.

The product step 80 may also be used in the inverted position as shown in FIGS. 4 and 5. In this position, the long leg 84 rests flush against the tilt top 14 and the short foot 86 juts out from the tilt top 14 at a 90° angle from the surface of the tilt top 14 forming a product stop for keeping produce and the like from rolling off the tilt top 14.

To attach the product step 80 in the inverted position, the pins 102 of the locking clip 82 are inserted into the holes 92 and 92' of the product step 80 and the pins 104 are inserted between any two adjacent rungs 52 and/or 53 on the tilt top 14.

The product step 80 may also be used in the inverted position, forming a product stop, yet having the long leg 84 be the product stop and the short foot 86 resting flush against the top surface of the tilt top 14. In this fashion, a higher product stop is formed by the inverted product step 80. The shorter product stop as shown in FIG. 5 is preferably used for shorter items such as Boston lettuce, and the higher product stop (when the long leg 84 is the product stop) is preferably used for higher items such as romaine lettuce. More than one of the product steps may be used as a product stop or a product step on a single tilt top.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A height-adjustable, angle-adjustable display rack, comprising:

a base frame having a front end and a rear end;

an angle-adjustable tilt top having a top and a bottom end, and two sides connecting the top end and the bottom end; and a tilt bar attachable to the tilt top at various distances from the bottom end of the tilt top and attachable to the base frame at various distances from the front end of the base frame.

2. A display rack as set forth in claim 1 wherein the tilt bar has a flat bottom having two ends and an arm extending upwardly and spring-biased outwardly from each end, each arm terminating with a tip, the flat bottom being attachable to the base frame and the tips being attachable to the tilt top.

3. A height-adjustable, angle-adjustable display rack, comprising:

a base frame having a front end and a rear end;

an angle-adjustable tilt top having a top end, a bottom end, two sides connecting the top end and the bottom end, and a top portion and a bottom portion which are slidable with each other, each portion having rungs which are parallel with the bottom end of the tilt top and cross wires which are perpendicular to the bottom end of the tilt top;

a locking bar sized to fit between two adjacent rungs on the top portion and two adjacent rungs on the bottom portion and around two cross wires on the top portion and two cross wires on the bottom portion to secure the tilt top in the position having the desired amount of expansion; and a tilt bar attachable to the tilt top and attachable to the base frame at various distances from the front end of the base frame, whereby the angle of the tilt top is adjustable with respect to the base frame.

4. A height-adjustable, angle-adjustable display rack, comprising:

a base frame having a front end and a rear end;

an angle-adjustable tilt top having a top end, a bottom end, and two sides connecting the top end and the bottom end;

a tilt bar attachable to the tilt top and attachable to the base frame at various distances from the front end of the base frame;

an elongated product step having an L-shaped cross section, the L-shaped cross section having a long leg and a short foot; and means for attaching the product step to the tilt top in two positions, one position being such that the long leg of the product step forms a step on the tilt top and the other position being such that the long leg of the product step is flush with the tilt top and the short foot extends outwardly from the tilt top forming a product stop.

5. A height-adjustable, angle-adjustable display rack, comprising:

a base frame having a front end and a rear end;

an angle-adjustable tilt top having a top ends, a bottom end, two sides connecting the top end and the bottom end, and loops at various locations on both sides thereof; and a tilt bar attachable to the tilt top and attachable to the base frame at various distances from the front end of the base frame, the tilt bar including a flat bottom having two ends and an arm extending upwardly and outwardly from each end, each arm terminating with a tip, the flat bottom being attachable to the base frame and the tips being attachable to the tilt top, the loops on the tilt top being sized so that the tips of the tilt bar are insertable therein, whereby the angle of the tilt top is adjustable with respect to the base frame.

6. A height-adjustable, angle-adjustable display rack, comprising:

a base frame having a front end and a rear end;

a tilt top having a top end, a bottom end, and two sides connecting the top end and the bottom end, the tilt top being expandable to expand its height from the top end to the bottom end and being attachable to the base frame at various distances from the front end of the base frame; and a tilt bar attachable to the tilt top and the base frame in such a way that the tilt top may be supported at various angles;

an elongated product step having an L-shaped cross section, the L-shaped cross section having a long leg and a short foot; and means for attaching the product step to the tilt top in two positions, one position being such that the long leg of the product step forms a step on the tilt top and the other position being such that the long leg of the product step is flush with the tilt top and the short foot extends outwardly from the tilt top forming a product stop.

7. A height-adjustable, angle-adjustable display rack, comprising:

a base frame having a front end and a rear end;

a tilt top having a top end, a bottom end, two sides connecting the top end and the bottom end, and a top portion and a bottom portion which are slidable with each other making the tilt top capable of expanding, each portion having rungs which are parallel with the bottom end of the tilt top and cross wires which are perpendicular to the bottom end of the tilt top, the tilt top being attachable to the base frame at various distances from the front end of the base frame;

a locking bar sized to fit between two adjacent rungs on the top portion and two adjacent rungs on the bottom portion and around two cross wires on the top portion and two cross wires on the bottom portion to secure the tilt top in the position having the desired amount of expansion; and a tilt bar attachable to the tilt top and the base frame in such a way that the tilt top may be supported at various angles.

8. A height-adjustable, angle-adjustable display rack, comprising:

a base frame having a front end and a rear end;

a tilt top having a top end., a bottom end, two sides connecting the top end and the bottom end, and loops at various locations on both sides thereof, the tilt top being expandable to expand its height from the top end to the bottom end and being attachable to the base frame at various distances from the front end of the base frame; and a tilt bar attachable to the tilt top and the base frame in such a way that the tilt top may be supported at various angles, the tilt bar including a flat bottom having two ends and an arm extending upwardly and outwardly from each end, each arm terminating with a tip, the flat bottom being attachable to the base frame and the tips being attachable to the tilt top, the loops on the tilt top being sized so that the tips of the tilt bar are insertable therein.

9. A height-adjustable, angle-adjustable display rack, comprising:

a base frame having a front end and a rear end;

an uniplanar tilt top having a top end, a bottom end, and two sides connecting the top end and the bottom end, the tilt top being expandable to expand its height from the bottom end to the top end and being is attachable to the base frame at various distances from the front end of the base frame; and a tilt bar attachable to the base frame at various distances from the front end of the base frame and attachable to the tilt top at various distances from the bottom end of the tilt top.

10. A display rack as set forth in claim 9, further comprising:

an elongated product step having an L-shaped cross section, the L-shaped cross section having a long leg and a short foot; and means for attaching the product step to the tilt top in two positions, one position being such that the long leg of the product step forms a step on the tilt top and the other position being such that the long leg of the product step is flush with the tilt top and the short foot extends outwardly from the tilt top forming a product stop.

11. A display rack as set forth in claim 9, wherein the tilt bar has a flat bottom having two ends and an arm extending upwardly and outwardly from each end, each arm terminating with a tip, the flat bottom being attachable to the base frame and the tips being attachable to the tilt top.

12. A display rack as set forth in claim 11, wherein the tilt top has loops at various locations on both sides thereof, the loops being sized so that the tips of the tilt bar are insertable therein.

13. A height-adjustable, angle-adjustable display rack, comprising:

a base frame having a front end and a rear end;

an angle-adjustable uniplanar tilt top having a top end, a bottom end, and two sides connecting the top end and the bottom end, the tilt top having loops at various locations on both sides thereof and being expandable to expand its height from the bottom end to the top end and being attachable to the base frame at various distances from the front end of the base frame; and a tilt bar having a flat bottom having two ends and an arm extending upwardly and outwardly from each end, each arm terminating with a tip, the flat bottom being attachable to the base frame at various distances from the front end of the base frame and the tips of the arms being insertable in the loops of the tilt top.

14. A produce display rack for displaying produce at an angle, comprising:

a tilt top having a top end and a bottom end, the tilt top being supported at an angle so that it may display produce at an angle; and at least one product stop attachable to the tilt top between the top and bottom ends which juts out from the tilt top at an angle relative to the surface of the tilt top to stop produce from rolling down the surface of the tilt top.

15. A produce display rack for displaying produce at an angle, comprising:

a tilt top having a top end and a bottom end, the tilt top being supported at an angle so that it may display produce at an angle; and at least one product step attachable to the tilt top between the top and bottom ends which forms a step on the tilt top for supporting and displaying groceries, such as quarts of fruit or the like, such that they can be displayed in a high profile fashion.

* * * * *